US008815791B2

(12) United States Patent
Neplenbroek et al.

(10) Patent No.: US 8,815,791 B2
(45) Date of Patent: Aug. 26, 2014

(54) CLEANING OF A COOKING DEVICE OR APPLIANCE WITH A COMPOSITION COMPRISING A BUILT-IN RINSE AID

(75) Inventors: Antonius Maria Neplenbroek, Soest (NL); Jan Eduard Veening, De Meern (NL); Robert Jan Uhlhorn, Tricht (NL); Elodie Chantal Lucas, Lumbres (NL)

(73) Assignee: Diversey, Inc.

( * ) Notice: Subject to any disclaimer, the term of this patent is extended or adjusted under 35 U.S.C. 154(b) by 680 days.

(21) Appl. No.: 13/132,413

(22) PCT Filed: Dec. 1, 2009

(86) PCT No.: PCT/US2009/066161

§ 371 (c)(1),
(2), (4) Date: Jul. 5, 2011

(87) PCT Pub. No.: WO2010/065481

PCT Pub. Date: Jun. 10, 2010

(65) Prior Publication Data

US 2012/0118321 A1 May 17, 2012

Related U.S. Application Data

(60) Provisional application No. 61/119,287, filed on Dec. 2, 2008.

(51) Int. Cl.

| | |
|---|---|
| ***C11D 3/22*** | (2006.01) |
| ***C11D 3/00*** | (2006.01) |
| ***C11D 3/37*** | (2006.01) |
| ***C11D 17/04*** | (2006.01) |
| *C11D 1/62* | (2006.01) |

(52) U.S. Cl.
CPC *C11D 3/227* (2013.01); *C11D 1/62* (2013.01); *C11D 3/0057* (2013.01); *C11D 3/3757* (2013.01); *C11D 17/044* (2013.01)
USPC ..... 510/470; 510/218; 510/234

(58) Field of Classification Search
CPC ... C11D 3/0057; C11D 17/0052; C11D 3/222
USPC ..... 510/197
See application file for complete search history.

(56) References Cited

U.S. PATENT DOCUMENTS

| | | | | |
|---|---|---|---|---|
| 3,183,110 | A * | 5/1965 | Aler et al. | 106/287.14 |
| 3,379,721 | A | 4/1968 | Reid | |
| 3,591,509 | A | 7/1971 | Parks et al. | |
| 3,625,854 | A | 12/1971 | Gower et al. | |
| 3,663,445 | A | 5/1972 | Augustin et al. | |
| 4,005,025 | A | 1/1977 | Kinstedt | |
| 4,167,488 | A | 9/1979 | Murtaugh | |
| 4,663,159 | A | 5/1987 | Brode, II et al. | |
| 5,126,068 | A | 6/1992 | Burke et al. | |
| 5,411,585 | A | 5/1995 | Avery et al. | |
| 5,418,006 | A | 5/1995 | Roth et al. | |
| 5,597,793 | A | 1/1997 | Besse et al. | |
| 5,662,998 | A * | 9/1997 | Harry, Jr. | 428/332 |
| 5,759,980 | A | 6/1998 | Russo et al. | |
| 6,025,314 | A | 2/2000 | Nitsch et al. | |
| 6,087,319 | A | 7/2000 | Norman | |
| 6,239,091 | B1 | 5/2001 | Tartakovsky et al. | |
| 6,333,299 | B1 | 12/2001 | Pace et al. | |
| 7,763,576 | B2 * | 7/2010 | Tjelta et al. | 510/147 |
| 8,158,207 | B2 | 4/2012 | Swidler | |
| 2002/0172656 | A1 | 11/2002 | Biedermann et al. | |
| 2003/0022804 | A1 | 1/2003 | Tadrowski et al. | |
| 2003/0073596 | A1 | 4/2003 | Chiou et al. | |
| 2003/0119706 | A1 | 6/2003 | Pfeiffer et al. | |
| 2006/0079435 | A1 * | 4/2006 | Llosas et al. | 510/499 |
| 2006/0252664 | A1 | 11/2006 | Cramer et al. | |
| 2008/0194453 | A1 | 8/2008 | Lang | |
| 2009/0011973 | A1 * | 1/2009 | Besse et al. | 510/445 |
| 2009/0081755 | A1 * | 3/2009 | Schmiedel et al. | 435/183 |
| 2009/0087390 | A1 | 4/2009 | Modi | |
| 2009/0176687 | A1 * | 7/2009 | Tjelta et al. | 510/445 |
| 2009/0176688 | A1 * | 7/2009 | Tjelta et al. | 510/445 |
| 2009/0288683 | A1 * | 11/2009 | Cummings et al. | 134/19 |
| 2010/0154831 | A1 * | 6/2010 | Neplenbroek et al. | 134/25.2 |
| 2012/0118321 | A1 * | 5/2012 | Neplenbroek et al. | 134/7 |

FOREIGN PATENT DOCUMENTS

| | | |
|---|---|---|
| DE | 102004016821 | 10/2005 |
| EP | 0467472 | 1/1992 |
| EP | 0875555 | 11/1998 |
| EP | 0892220 | 1/1999 |
| EP | 1235895 | 9/2002 |
| EP | 1721963 | 11/2006 |

(Continued)

OTHER PUBLICATIONS

The International Search Report prepared by the European Patent Office Mar. 15, 2010.

Final Office Action issued in corresponding Chinese Application No. 200980156061.4, Sep. 26, 2013.

Patent Examination Report No. 1 issued in corresponding Australian Application No. 2009322572, Nov. 27, 2013.

Office Action issued in corresponding Japanese Application No. 2011-539621, Nov. 7, 2013.

* cited by examiner

*Primary Examiner* — Gregory Webb

(74) *Attorney, Agent, or Firm* — Bell & Manning, LLC

(57) ABSTRACT

The present invention discloses a method for cleaning a cooking device or appliance comprising contacting at least the cooking chamber of the cooking device or appliance with a cleaning composition comprising a sheeting polymer that provides a layer on the surfaces of at least the cooking chamber so as to afford a sheeting action in an aqueous rinse step. The sheeting polymer is selected from the group of cationic polysaccharides and maleic acid-olefin copolymers.

10 Claims, No Drawings

(56) References Cited

FOREIGN PATENT DOCUMENTS

| | | |
|---|---|---|
| EP | 1743906 | 1/2007 |
| JP | 2007099811 | 4/2007 |
| JP | 2007169473 | 7/2007 |
| WO | WO 9423000 | 10/1994 |
| WO | WO 94/26858 | 11/1994 |
| WO | WO 99/60086 | 11/1999 |
| WO | 20031073002 | 9/2003 |
| WO | WO 2004113484 | 12/2004 |
| WO | 20061119162 | 11/2006 |
| WO | WO 2006115658 | 11/2006 |
| WO | WO 2008147940 | 12/2008 |
| WO | WO 2009006603 | 1/2009 |
| WO | WO 2010065483 | 6/2010 |

CLEANING OF A COOKING DEVICE OR APPLIANCE WITH A COMPOSITION COMPRISING A BUILT-IN RINSE AID

BACKGROUND OF THE INVENTION

Commonly applied cleaning methods for a cooking device or appliance typically comprise a cleaning step which is followed by a rinse and descaling step, to prevent leaving water marks and/or scale deposition in the cooking cavity by the rinse water while it is drying off.

EP 0 892 220 discloses a method for cleaning the interior of an oven for the heating of foods, whereby the floor of the oven interior is at least completely covered with a cleaning solution, and whereby the cleaning solution is circulated by a circulation device, so that the inside surfaces of the interior are flushed with this cleaning solution. After cleaning, the cleaning solution may be neutralised and/or a descaling agent may be applied. The cleaning concentrate and descaling agent are supplied to the interior of the oven via separate containers. Additional water can be supplied into the interior of the oven via an external water connection upon utilization of the conduits for cleaning concentrate and descaling agent.

WO 2003/073002 relates to a method for cleaning the interior of cooking devices, wherein at least one cleaning, rinsing and/or descaling agent is used in solid and compressed form, dissolvable in a liquid and in the form of a cleaning, rinsing and/or descaling tablet, or at least one multiphase tablet containing a cleaning phase, rinse phase and/or descaling phase component that were produced at different molding pressures and/or at different molding intervals. The dissolution behavior of the solid can be influenced by adding suitable dissolution retarders and by the way the cleaning agent is introduced into the cooking compartment. The temporal dissolution behavior of tablets or multiphase tablets can be controlled via a fan wheel in the cooking chamber.

DE 10 2004 016 821 discloses cleaning of the interior of cooking equipment including a cooking space, an outlet and/or a condenser comprises the following treatments at least in the cooking space (1) a vapor treatment phase involving use of a vapor atmosphere for a given time; (2) a rinsing phase involving use of a first fluid, especially a rinse-wash liquor; and (3) a post-washing phase involving use of a second fluid, especially rinsing with a post-washing liquor. In preferred embodiments, the rinsing phase is preceded by at least one descaling phase involving use of a descaling liquor.

Common rinse-aid liquors for oven cleaning typically contain a non-ionic surfactant and a descaling agent, such as citric acid.

Despite the numerous efforts in the field of cleaning cooking appliances, there is still the need to avail of a simple cleaning method that allows a rinsing step using tap water only and that does not leave water marks, scale deposits, and the like, in the cooking chamber.

SUMMARY OF INVENTION

The present invention relates to a method for cleaning a cooking device or appliance wherein a composition is used that contains a built-in rinse aid.

DETAILED DESCRIPTION

The present invention is directed to a simple and effective method for cleaning a cooking device or appliance, which method obviates the use of a separate rinse aid and/or descaling agent and is applicable to any cooking device or appliance.

Thus, the present invention provides a method for cleaning a cooking device or appliance wherein a composition is used that contains a built-in rinse aid, obviating the need to use rinse aids and/or descaling agents in a separate rinse step after the cleaning step. The method comprises contacting at least the cooking chamber of the cooking device or appliance with a cleaning composition comprising a sheeting polymer that provides a layer on the surfaces of at least the cooking chamber so as to afford a sheeting action in an aqueous rinse step.

The cleaning of a cooking device or appliance encompasses at least the cleaning of the cooking chamber of the cooking device or appliance.

Throughout the description, the terms "cooking device", "cooking appliance" or "oven" are used synonymously.

The cleaning composition to be used for cleaning an cooking device or appliance as described herein contains a sufficient amount of a sheeting polymer to provide a layer on the surfaces of the cooking device or appliance so as to afford a sheeting action in the aqueous rinse step. The sheeting polymer that is suitable for use in the cleaning composition thus should sufficiently adsorb on the oven surfaces.

Use of such a sheeting polymer in the cleaning composition advantageously obviates the need to use a rinse aid and/or a descaling agent in a separate rinse step which is applied after the cleaning step. It was surprisingly found that a good visual appearance was obtained without a rinse step with a rinse aid liquor. This rinse step now advantageously may be done using water, e.g. tap water, softened water or demineralised water. Use of the sheeting polymer in the cleaning composition further advantageously enables removal of the alkaline detergent from the oven cavity without applying a neutralisation procedure.

The cleaning composition and method as described herein provides an overall improved rinsing and/or drying behavior, such as reduced remaining number of droplets, a reduced alkalinity without separate neutralisation and improved visual appearance of the oven surfaces.

Without wishing to be bound by theory, it is believed that the sheeting polymer adsorbs on the inside surfaces of the oven, during the cleaning process. The layer of adsorbed sheeting polymer generally makes these surfaces more hydrophilic. The sheeting polymer thus should be capable to adsorb on the inside surfaces of the cooking device or appliance to provide a layer thereon so as to afford a sheeting action in the aqueous rinse step. Water droplets getting into contact with these hydrophilically modified surfaces during rinsing will wet better implying that a continuous thin water film is fanned in stead of separate droplets. This thin water film will dry more uniformly without leaving water marks behind. Therefore, a good visual appearance is obtained without the need to use a rinse aid and/or a descaling agent in the rinse step.

The sheeting polymer preferably is a polymer selected from the group consisting of cationic polysaccharides and maleic acid-olefin copolymers.

The sheeting polymer preferably constitutes 0.01% to 50% (w/w) of the cleaning composition, more preferably 0.1% to 20% (w/w), even more preferably 0.2 to 10% (w/w), even more preferably 0.5% to 5% (w/w), most preferably 1 to 5% (w/w), based on total (wet or dry) weight of the cleaning composition.

Typically, the concentration of the sheeting polymer in the cleaning solution directly applied to clean the oven is from 5 to 1000 ppm, preferably from 10 to 500 ppm, more preferably from 20 to 300 ppm.

The sheeting polymer typically is incorporated in the cleaning solution directly applied to clean the cooking device or appliance as part of the concentrated liquid or solid cleaning composition. However, it is also possible to add the polymer to the cleaning solution as a separately formulated product. Such a separately formulated product may contain a relatively high level (even 100%) of polymer. This separate product, which can be liquid or solid, may be dosed manually or automatically. This may for instance be done to solve stability issues between the polymer and the cleaning composition. In this way, the level of polymer in the cleaning composition can be adjusted flexibly and independently from the concentration of the other components of the cleaning composition, to provide a layer of polymer on the surface of the cooking device or appliance so as to afford a sheeting action in the aqueous rinse step.

Cationic Polysaccharides

As defined herein, a cationic polysaccharide is a polysaccharide containing a cationic group. The cationic charge on the cationic polysaccharide may be derived from ammonium groups, quaternary ammonium groups, guanidium groups, sulfonium groups, phosphonium groups, bound transition metals, and other positively charged functional groups.

A preferred cationic group is a quaternary ammonium group according to the formula

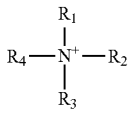

wherein $R_1$, $R_2$, $R_3$ and $R_4$ each independently are a lower alkyl or a lower hydroxyalkyl group. More preferably $R_1$, $R_2$, $R_3$ and $R_4$ each independently are a C1-C6 alkyl or a C1-C6 hydroxyalkyl group. Even more preferably, $R_1$, $R_2$ and $R_3$ are identical C1-C4 alkyl groups and R4 is a C3-C6 hydroxyalkyl group. Even more preferably, $R_1$, $R_2$ and $R_3$ are methyl groups and R4 is a C3-C6 hydroxyalkyl group. Most preferred Inc cationic group is a quaternary 2-hydroxy-3-(trimethylanomonium)propyl group.

A cationic group may be connected to the polysaccharide via an ether or an ester linkage.

The polysaccharide component of the cationic polysaccharide is a polymer comprising monosaccharide units linked by glycosidic linkages. The monosaccharide unit may be an aldose or a ketose of 5 or 6 carbon atoms. The polysaccharide may be a homopolysaccharide or a heteropolysaccharide, it may be linear or branched, it may be partially hydrolysed, it may contain substituents, and/or it may be hydrophobically modified.

Suitable polysaccharide polymers may be cellulose-based, pectin-based, starch-based, natural gum-based.

Examples of cellulose-based polysaccharides are hydroxyethylcellulose, hydrophobically modified hydroxyethylcellulose, ethyl hydroxyethyl cellulose, hydrophobically modified ethyl hydroxyethyl cellulose, hydroxypropylcellulose or sodium carboxymethylcellulose.

Examples of starch-based polysaccharides are starches from rice, tapioca, wheat, corn or potato.

Examples of natural gum-based polysaccharides are polygalactomannans like guar gums or locust bean gums, polygalactans like carrageenans, polyglucans like xanthan gums, polymannuronates like alginate. Preferred natural gums are based on guar gum.

Preferred cationic polysaccharides are cationic guars such as Guar gum 2-hydroxy-3-(trimethylammonium)propyl ether chloride and Guar gum 2-hydroxypropyl, 2-hydroxy-3-(trimethylammortio) propyl ether chloride. Suitable cationic guars are sold under the trade name Jaguar by Rhodia. Also preferred are cationic starches such as (3-Chloro-2-Hydroxypropyl)Trimethylammonium Chloride modified starch. Suitable cationic starches are sold under the trade name HI-CAT by Roquette, SolsaCAT by Starch Solution Internasional Kawasan and CATO by National Starch & Chemical. Also preferred are cationic celluloses such as cationic hydroxyethyl cellulose. Suitable cationic celluloses are sold under the trade name Softcat and Ucare by Dow.

Particularly preferred are the following polysaccharides:

- Cationically modified guar gums, such as Jaguar C 17, Jaguar C 162 and Jaguar C 1000 (Rhodia).
- Cationically modified starches, such as HI-CAT CWS 42 (Roquette) and SolsaCAT 22 and SolsaCAT 16A (Starch Solution Internasional Kawasan) and CATO 308 (National Starch & Chemical).
- Cationically modified celluloses, such as SoftCAT SX-400H and UCARE LR 30 M (Dow).

These cationic polysaccharides can be used alone or in combination with other polysaccharides or with polymeric or nonionic surfactants as described in WO2006/119162 in the cleaning composition.

Cationic polysaccharides, such as the Jaguar, HI-CAT, Solsacat, CATO, Softcat and UCARE polysaccharides, may be combined with certain anions, such as silicate and/or phosphonate and/or phosphate and/or hydroxide and/or citrate and/or gluconate and/or lactate and/or acetate anions. Both for liquid and solid compositions, properties like drying performance and product stability can be influenced by the type of anion and the order of addition of the components when making these compositions.

Maleic Acid-Olefin Copolymer

Preferred maleic acid-olefin copolymers for use in the compositions as described herein have the formula

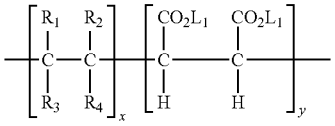

wherein $L_1$ is selected frown the group of hydrogen, ammonium or an alkali metal; and $R_1$, $R_2$, $R_3$ and $R_4$ are each independently selected from the group of hydrogen or an alkyl group (straight or branched, saturated or unsaturated) containing from 1 to about 8 carbon atoms, preferably from 1 to about 5 carbon atoms. The monomer ratio of x to y is from about 1:5 to about 5:1, preferably from about 1:3 to about 3:1, and most preferably from 1.5:1 to about 1:1.5. The average molecular weight of the copolymer will typically be less than about 20,000, more typically between about 4,000 and about 12,000. These copolymers can be provided by known and conventional means. Such copolymers are described in for instance U.S. Pat. No. 5,126,068, the description and preparation of which is incorporated herein by reference.

An especially preferred maleic acid-olefin copolymer for use in the cleaning composition is a maleic acid-di-isobutylene copolymer having an average molecular weight of about 12,000 and a monomer ratio (x to y) of about 1:1. Such a copolymer is available from the BASF Corporation under the trade name "Sokalan CP-9" [$L_1$ is hydrogen or sodium, $R_1$ and $R_3$ are hydrogen, $R_2$ is methyl, and $R_4$ is neopentyl]. Another preferred product is a maleic acid-trimethyl isobutylene ethylene copolymer [$L_1$ is hydrogen or sodium, $R_1$ and $R_3$ are methyl, $R_2$ is hydrogen and $R_4$ is tertiary butyl].

Composition Comprising the Sheeting Polymer

In addition to the sheeting polymers described herein above, the composition may comprise conventional detergent ingredients, preferably selected from alkalinity sources, builders (i.e. detergency builders including the class of chelating agents/sequestering agents), bleaching systems, anti-scalants, corrosion inhibitors, surfactants, antifoams and/or enzymes. Suitable caustic agents include alkali metal hydroxides, e.g. sodium or potassium hydroxides, and alkali metal silicates, e.g. sodium metasilicate. Especially effective is sodium silicate having a mole ratio of $SiO_2$:$Na_2O$ of from about 1.0 to about 3.3. The pH of the cleaning composition typically is in the alkaline region, preferably ≥9, more preferably ≥10.

Builder Materials

Suitable builder materials (phosphates and non-phosphate builder materials) are well known in the art and many types of organic and inorganic compounds have been described in the literature. They are normally used in all sorts of cleaning compositions to provide alkalinity and buffering capacity, prevent flocculation, maintain ionic strength, extract metals from soils and/or remove alkaline earth metal ions from washing solutions.

The builder material usable herein can be any one or mixtures of the various known phosphate and non-phosphate builder materials. Examples of suitable non-phosphate builder materials are the alkali metal citrates, carbonates and bicarbonates; and the salts of nitrilotriacetic acid (NTA); methylglycine diacetic acid (MGDA); glutaric diacetic acid (GLDA), polycarboxylates such as polymaleates, polyacetates, polyhydroxyacrylates, polyacrylate/polymaleate and polyacrylate/polymethacrylate copolymers, as well as zeolites; layered silicas and mixtures thereof. They may be present (in % by wt.), in the range of from 1 to 70, and preferably from 5 to 60, more preferably from 10 to 60.

Particularly preferred builders are phosphates, NTA, EDTA, MGDA, GLDA, citrates, carbonates, bicarbonates, polyacrylate/polymaleate, maleic anhydride/(meth)acrylic acid copolymers, e.g. Sokalan CP5 available from BASF.

Antiscalants

Scale formation on oven parts can be a significant problem. It can arise from a number of sources but, primarily it results from precipitation of either alkaline earth metal carbonates, phosphates or silicates. Calcium carbonate and phosphates are the most significant problem. To reduce this problem, ingredients to minimize scale formation can be incorporated into the composition. These include polyacrylates of molecular weight from 1,000 to 400,000 examples of which are supplied by Rohm & Haas, BASF and Alco Corp. and polymers based on acrylic acid combined with other moieties. These include acrylic acid combined with maleic acid, such as Sokalan CP5 and CP7 supplied by BASF or Acusol 479N supplied by Rohm & Haas; with methacrylic acid such as Colloid 226/35 supplied by Rhone-Poulenc; with phosphonate such as Casi 773 supplied by Buckman Laboratories; with maleic acid and vinyl acetate such as polymers supplied by Huls; with acrylamide; with sulfophenol methallyl ether such as Aquatreat AR 540 supplied by Alco; with 2-acrylamido-2-methylpropane sulfonic acid such as Acumer 3100 supplied by Rohm & Haas or such as K-775 supplied by Goodrich; with 2-acrylamido-2-methylpropane sulfonic acid and sodium styrene sulfonate such as K-798 supplied by Goodrich; with methyl methacrylate, sodium methallyl sulfonate and sulfophenol methallyl ether such as Alcosperse 240 supplied by Alco; polymaleates such as Belclene 200 supplied by FMC; polymethacrylates such as Tamol 850 from Rohm & Haas; polyaspartates; ethylenediamine disuccinate; organo polyphosphonic acids and their salts such as the sodium salts of aminotri(methylenephosphonic acid) and ethane 1-hydroxy-1,1-diphosphonic acid. The anti-sealant, if present, is included in the composition from about 0.05% to about 10% by weight, preferably from 0.1% to about 5% by weight, most preferably from about 0.2% to about 5% by weight.

Surfactants

Surfactants and especially nonionics may be present to enhance cleaning and/or to act as defoamer. Typically used nonionics are obtained by the condensation of alkylene oxide groups with an organic hydrophobic material which may be aliphatic or alkyl aromatic in nature, e.g. selected from the group consisting of a C2-C18 alcohol alkoxylate having EQ PO, BO and PEO moieties or a polyalkylene oxide block copolymer.

The surfactant may be present in a concentration of about 0.1% to about 10% by weight, preferably from 0.5% to about 5% by weight, most preferably from about 0.2% to about 2% by weight.

Bleaches

Suitable bleaches for use in the system according the present invention may be halogen-based bleaches or oxygen-based bleaches. More than one kind of bleach may be used.

As halogen bleach, alkali metal hypochlorite may be used. Other suitable halogen bleaches are alkali metal salts of di- and tri-chloro and di- and tri-bromo cyanuric acids.

Suitable oxygen-based bleaches are the peroxygen bleaches, such as sodium perborate (tetra- or monohydrate), sodium percarbonate or hydrogen peroxide.

The amounts of hypochlorite, di-chloro cyanuric acid and sodium perborate or percarbonate preferably do not exceed 15%, and 25% by weight, respectively, e.g. from 1-10% and from 4-25% and by weight, respectively.

Enzymes

Amylolytic and/or proteolytic enzymes would normally be used as an enzymatic component. The enzymes usable herein can be those derived from bacteria or fungi.

Minor amounts of various other components may be present in the cleaning composition. These include solvents and hydrotropes such as ethanol, isopropanol, xylene sulfonates and cumene sulfonates; flow control agents; enzyme stabilizing agents; anti-redeposition agents; corrosion inhibitors; and other functional additives.

Components of the cleaning composition may independently be formulated in the form of solids (optionally to be dissolved before use), aqueous liquids or non-aqueous liquid (optionally to be diluted before use).

The oven cleaning composition may be in solid or liquid form. The solid may be a powder and/or a granulate, a tablet or a solid block. The liquid may be a conventional liquid (aqueous solution), emulsion, structured liquid or gel form. When in powder form, a flow aid may be present to provide good flow properties and to prevent lump formation of the powder.

In a preferred embodiment, the cleaning composition is a unit dose composition, preferably a powder and/or granular composition packed in a sachet of a water-soluble polymer, such as polyvinyl alcohol. Such dosing provides several advantages:

Ease of detergent dosage. Detergent dosing does not require any provision to hold the detergent and no specific dosing location for detergent dosing has to be defined. It is for instance possible to simply place the unit dose on the bottom of the oven to be cleaned.

Fast powder dissolution=fast cleaning. The current state of the art tablets have a slower dissolution, therefore a slower detergent availability and therefore require a longer cleaning time.

The sheeting polymer can be incorporated rather easily in cleaning compositions like tablets, blocks, powders or granules without sacrificing physical properties like flow and stability. The sheeting polymer, incorporated in the cleaning composition, can be in a liquid form, but also in solid form.

The cleaning methods as described herein may be utilized in any cooking device or appliance, such as a conventional (dry) oven or a steam-heated oven. A steam-heated oven typically comprises a heater, a blower, a steam generator, a cooking chamber, a cooking chamber drain, a steam condenser and a cooking appliance drain.

The cleaning methods as described herein may be done manually and/or automatically and may encompass for instance spraying, wiping, fogging and/or circulating the cleaning composition or a cleaning solution obtained by diluting or dissolving the cleaning composition in water in the oven space(s).

Typical cleaning processes based on circulation of a cleaning solution are conducted at a temperature of about 10 to about 90° C. and for a duration of about 1 to about 180 minutes, depending on e.g. the degree of fouling of the oven and the nature of the cleaning composition (a tablet will have a slower dissolution time, and thus will need a longer cleaning time, than a powder or granulate). The cleaning composition containing sheeting polymer may be added manually or dosed automatically in the cleaning solution contacting the oven.

In a convenient way, a water soluble sachet containing a cleaning composition comprising the sheeting polymer may simply be placed on the bottom of an oven chamber.

Some ovens have a reservoir for collecting cleaning liquid. The cleaning process may start by filling this reservoir with cleaning solution. The reservoir may also be filled with tap water only, for instance when using a sachet containing a solid cleaning composition. The water (or cleaning solution) is pumped through a nozzle at the upper side of the oven, distributed through the oven and collected in the reservoir. Simultaneously, steam is collected in a condenser placed above the reservoir, and condensed water flows in the reservoir. The sachet dissolves during the water/cleaning solution circulation process, in about 5 minutes. The duration of the cleaning process is in the range of 10-90 minutes (preset), depending on the degree of fouling of the oven. During circulation, the water/cleaning liquid is heated to a preset temperature, typically about 45-90° C., by the elements used for heating the air during cooking.

Another widely used automatic cleaning method is based on spraying of a cleaning solution at a temperature of about 10 to about 90° C. The cleaning solution sprayed into the oven may be a pure liquid cleaning product or a diluted liquid product. The dilution of the liquid product may be conducted during the spraying action in the oven. Prior to spraying of the cleaning solution, the oven interior may be preheated by steam or heaters. The spraying of the cleaning solution may be conducted by fixed or rotating nozzles.

In a convenient way, a liquid detergent containing a cleaning composition comprising the sheeting polymer may be dosed to the spraying facility of the oven.

After spraying the oven interior, the cleaning solution will contact the oven surfaces for a suitable time to soak and act upon soil in order to achieve effective cleaning. The soaking time may be 1 to 30 minutes depending on the degree of oven interior fouling.

After completion of the cleaning process, the cleaning liquid is discharged and the reservoir is filled with fresh (tap) water, which is circulated for about 1 to about 10 minutes, such as about 5 minutes, to remove soil and traces of the wash solution. The rinse liquid is then discharged. The rinse step with water may be repeated once or more. Finally, the oven cavity is dried at about 80° C. using the oven heating elements.

The cleaning and rinsing steps may be repeated several times. The number of repeats may depend on the degree of fouling of the oven interior.

It is also envisaged to use the cleaning composition comprising the sheeting polymer for periodically treating the cooking device or appliance. A treatment using a cleaning composition comprising a sheeting polymer as described herein may be alternated with one or more washings using a cleaning composition without sheeting polymer. Such a periodic treatment may be done with a relatively high concentration of sheeting polymer in the cleaning composition, providing e.g. 50 to 1000 ppm sheeting polymer in the cleaning solution.

With this concept of built-in rinse aid, a simpler cleaning process is obtained for institutional oven cleaning, which eliminates the need for using a separate rinse aid. Besides increased simplicity, this concept provides clear cost savings, like for raw materials, packaging, processing, transport and storage of the separate rinse aid.

The sheeting polymer which provides optimal drying properties in this concept of built-in rinse aid for oven cleaning processes can have some cleaning, defoaming, builder, binder, rheology modifying, thickening, structuring or corrosion inhibiting properties as well and so improve the overall cleaning process. In particular, a positive soil release effect on fatty type of soils was observed.

This invention will be better understood from the Examples which follow. However, one skilled in the art will readily appreciate that the specific methods and results discussed are merely illustrative of the invention and no limitation of the invention is implied.

EXAMPLE 1

In this example the effect of Sokalan CP 9 and a cationic polysaccharide present in an alkaline cleaning solution on visual appearance of the oven is tested:

Working Method

For this test an oven with an automatic cleaning process was used: Self Cooking Center from Rational. During the cleaning process about 8 L hot water (80 degrees C.) with cleaning product is pumped around and during 8 minutes circulated through the oven via nozzles. This wash solution is drained automatically and clean hot water is circulated during 3 minutes through the oven to rinse off remaining wash solution. Also this rinse water is drained automatically and the oven is dried by a hot air flow.

In order to evaluate visual appearance of the oven wall (made from stainless steel) and oven door (made from glass), 4 different stainless steel substrates and 1 glass substrate were clammed on a rack in the oven. New substrates were used for each test. In this way, effects from components adsorbed on these surfaces in a previous test, is prevented.

After the cleaning and drying process the visual appearance of these substrates was assessed. Each of the substrates was evaluated by giving a score from 0 (very significant level of watermarks clearly visible) to 10 (no visual watermarks).

For this test, tap water with a water hardness of 8 German Hardness was used. Furthermore, no product was added to the last rinse process (so rinsing with water only).

In these tests 3 different detergents were added to the wash solution. The compositions of the added detergents are given in table 1. Sokalan CP 9 is a maleic acid, olefin copolymer, sodiumsalt ex BASF. For the test with cationic polysaccharide present in the wash solution a cationically modified guar gum was used:

Jaguar C 1000; ex Rhodia; Guar gum, 2 hydroxy-3-(trimethylammonium)propyl ether chloride (CAS Nr: 65497-29-2).

TABLE 1

Compositions detergents

| Nr. | NaOH | NTA-Na3 | Sokalan CP 9 | Jaguar C1000 |
|---|---|---|---|---|
| 1 | 1 gram | 1 gram | — | — |
| 2 | 1 gram | 1 gram | 0.2 gram | — |
| 3 | 1 gram | 1 gram | — | 0.2 gram |

The results for the visual evaluation after the cleaning process with each of these detergent compositions are given in table 2.

TABLE 2

Visual appearance

| | | Steel substrate | | | |
|---|---|---|---|---|---|
| Nr. | Glass | 1 | 2 | 3 | 4 |
| 1 (Reference) | 5 | 6 | 6 | 5 | 5 |
| 2 (Sokalan CP 9) | 8 | 7 | 8 | 9 | 6 |
| 3 (Jaguar C1000) | 9 | 8 | 8 | 8 | 8 |

These results illustrate that this automatic cleaning process with reference product nr. 1 leads to the formation of a significant level of water marks on all surfaces in the oven. This is caused by water droplets which are attached to these surfaces after the cleaning and rinsing process and which are dried-in at these surfaces.

These results also illustrate that the presence of Sokalan CP 9 or Jaguar C1000 in the wash solution leads to much better visual appearance of these surfaces in the oven. Obviously, adsorption of these components on these surfaces during the cleaning process, prevents the formation of water droplets after the rinsing step and so improves visual appearance of the oven, without the need for adding a separate rinse product in the last rinse step.

EXAMPLE 2

In this example the effect of Sokalan CP 9 in an alkaline powder detergent in a PVA sachet is tested on visual appearance of the cooking cavity of an oven.

Working Method

For this test an oven with an automatic cleaning process was used. A sachet with 60 gram of reference detergent (Detergent 1) was put on the bottom of the oven cavity. Then the cleaning process was started. During the cleaning process about 10 L hot water of 80 degrees C. with cleaning product is pumped around and during 45 minutes circulated through the oven via the nozzle. During the first 5 minutes of the cleaning process the detergent dissolved.

This wash solution is drained automatically and clean hot water is circulated during 5 minutes through the oven to rinse off remaining wash solution. Also this rinse water is drained automatically. This rinse procedure is repeated once. Finally the oven is dried by a hot air flow of 80 degrees C.

After the cleaning procedure, visual appearance of the oven wall was assessed. The oven wall was evaluated by giving a score from 0 (very significant level of watermarks clearly visible) to 10 (no visual watermarks).

The test was repeated using the same system parameters and a sachet with 60 gram of similar detergent, but also containing 4% Sokalan CP 9 (Detergent 2).

For this test, tap water with a water hardness of 8 German Hardness was used. Furthermore, no product was added to the last rinse process (so rinsing with water only).

The compositions of the added detergents are given in table 3.

TABLE 3

Detergent compositions

| Component | Detergent 1 (reference) | Detergent 2 |
|---|---|---|
| sodium triphosphate | 40.0% | 40.0% |
| sodium metasilicate | 54.0% | 50.0% |
| acrylic copolymer | 2.0% | 2.0% |
| defoaming non-ionic | 4.0% | 4.0% |
| Sokalan CP 9 | — | 4.0% |
| | 100.0% | 100.0% |

The results for the visual evaluation after the cleaning process with each of these detergent compositions are given in table 4.

TABLE 4

Visual appearance

| | Oven wall |
|---|---|
| 1 Detergent 1 (reference) | 5 |
| 2 Detergent 2 (Sokalan CP 9) | 8 |

These results illustrate that this automatic cleaning process with reference Detergent 1 leads to the formation of a significant level of water marks on the oven wall surfaces. This is caused by water droplets which are attached to these surfaces after the cleaning and rinsing process and which are dried-in at these surfaces.

These results also illustrate that Detergent 2 with Sokalan CP 9 leads to much better visual appearance of the surface in the oven. Obviously, adsorption of this polymer on the oven wall during the cleaning process, prevents the formation of water droplets after the rinsing step and so improves visual appearance of the oven, without the need for adding a separate rinse product in the last rinse step.

This example also demonstrates that placing a sachet with this detergent on the bottom of the oven is an effective way to apply and use this product.

EXAMPLE 3

In this example the effect of various cationic polysaccharides present in a cleaning solution on visual appearance of the oven is tested. These cationic polysaccharides are based on different cationic modifications of several types of polysaccharides, like potato and tapioca starches, guar gums and celluloses.

For comparison, the visual appearance effects are also determined for a number of polymers which are not cationic polysaccharides. These polymers include standard polysaccharides (like starch, guar and cellulose), polyacrylic homopolymer or copolymers, polymers offered for surface modification and a cationic acrylic copolymer.

Finally, visual appearance of an automatic cleaning process with a wash solution containing product Etolit Clean (ex Etol Nederland) was determined. This product is recently introduced in the market, claiming cleaning and rinsing of automatically cleaned ovens in one product. The product contains potassium-hydroxide and <5% amphoteric tenside.

Working Method

For this test an oven with automatic cleaning process was used: Self cooking Center from Rational. The same cleaning process as described in example 1 is applied; in these trials soft water is used.

In order to evaluate visual appearance of the oven wall (made from stainless steel) and oven door (made from glass), a stainless steel substrate and a glass substrate were attached in the oven. New substrates were used for each test. After the cleaning process the visual appearance of these substrates was evaluated, by counting the number of spots, caused by drying-in of water droplets.

In the first part, the effect of the following 8 different cationic polysaccharides was tested:

- HI-CAT CWS 42 ex Roquette Freres; cold water soluble cationic potato starch (CAS Nr : 56780-58-6).
- SolsaCAT 22; ex Starch Solution Internasional Kawasan; Cationic tapioca starch derivative (CAS Nr: 56780-58-6).
- SolsaCAT 16A; ex Starch Solution Internasional Kawasan; Cationic tapioca starch derivative (CAS Nr: 56780-58-6)
- CATO 308; ex National Starch & Chemical; Cationic tapioca starch-quaternary amine (0.35% N).
- Jaguar C162; ex Rhodia; Guar gum, 2-hydroxypropyl, 2-hydroxy-3-(trimethylammonio) propyl ether chloride (CAS Nr: 71329-50-5).
- Jaguar C 1000; ex Rhodia; Guar gum, 2 hydroxy-3-(trimethylammonium)propyl ether chloride (CAS Nr: 65497-29-2).
- SoftCAT SX-400H; ex Dow; >91% Cationic hydroxyethyl cellulose (CAS Nr.: 68610-92-4).
- UCARE LR 30 M; ex Dow; >91% Cationic hydroxyethyl cellulose (CAS Nr.: 68610-92-4).

In the second part the effect of the following 8 (not cationic polysaccharide) polymers was tested:

- Potato Starch; ex Acros Organics (CAS Nr: 9005-25-8).
- Meypro guar CSAA 200/50-F; ex Danisco; guar gum.
- Blanose 7 HF Pharm; ex Hercules; cellulose gum.
- Sokalan CP5; ex BASF; polyacrylic acid-maleic acid copolymer.
- Acusol 445 NG; ex Rohm & Haas; Granulated acrylic acid homopolymer.
- Polyquart Pro; ex Cognis; Acrilic copolymer, sodium salt.
- Rewocare 755; ex Evonik; aqueous preparation of modified polymers with pigment affinitive groups.
- Salcare SC60; ex Ciba; cationic acrylic copolymer.

Cleaning detergents were prepared with each of these components, containing 1% cationic polysaccharide (part A) or 1% (not cationic polysaccharide) polymers (part B). Furthermore, these detergents contained 69% water, 10% KOH (50% solution), 3% Briquest ADPA 60A (60% HEDP-solution) and 17% GLDA (38% solution). The cationic polysaccharides or (not cationic polysaccharide) polymers were first dissolved in hot water by stirring for 15 minutes at 60 degrees C. Then HEDP, KOH and GLDA were added, while stirring. Furthermore, a reference detergent was prepared, containing similar levels of water, HEDP, KOH and GLDA, but no polymer.

From each of these detergents, 20 gram was added into the wash solution at the beginning of the cleaning process. The results from the visual evaluation of the substrates after the cleaning process are given in table 5A for detergents containing cationic polysaccharides and table 5B for detergents containing (not cationic polysaccharide) polymers and for Etolite Clean.

TABLE 5A

Visual appearance; number of spots for cationic polysaccharides present in wash solution

| Cationic Polysaccharide | Steel Substrate | Glass substrate |
|---|---|---|
| 1 none: Reference test | 24 | 23 |
| 2 Hi Cat CWS42 | 0 | 0 |
| 3 SolsaCAT 22 | 1 | 2 |
| 4 SolsaCAT 16A | 0 | 0 |
| 5 Cato 308 | 0 | 8 |
| 6 Jaguar C162 | 0 | 7 |
| 7 Jaguar C1000 | 8 | 3 |
| 8 SoftCAT SX-400H | 0 | 13 |
| 9 UCARE LR 30M | 11 | 9 |

These results illustrate that this automatic cleaning process with reference detergent 1 leads to many spots on steel and glass surfaces, which are caused by evaporation of water droplets which are attached to these surfaces after the cleaning and rinsing process.

These results also illustrate that detergents 2 to 9 with different cationic polysaccharides lead to much less spots and so much better visual appearance of the surfaces in the oven. Obviously, adsorption of these various cationic polysaccharides on the oven wall during the cleaning process, prevents the formation of water droplets after the rinsing step and so improves visual appearance of the oven, without the need for adding a separate rinse product in the last rinse step.

TABLE 5B

Visual appearance; number of spots for (not cationic polysaccharide) polymers present in wash solution

| Polymer | Steel substrate | Glass substrate |
|---|---|---|
| 1 None: reference | 24 | 23 |
| 10 Potato Starch | 24 | 10 |
| 11 Meypro guar | 55 | 16 |
| 12 Cellulose Gum | 51 | 26 |
| 13 Sokalan CP5 | 51 | 27 |
| 14 Acusol 445 NG | 58 | 17 |
| 15 Polyquart Pro | 19 | 14 |
| 16 Rewocare 755 | 25 | 10 |
| 17 Salcare SC60 | 45 | 11 |
| 18 Etolit clean | 31 | 14 |

These results illustrate that automatic cleaning processes with (not cationic polysaccharide) polymers lead to many watermarks on steel and glass substrates. Presence in the cleaning solution of standard polysaccharides, but also polyacrylic homopolymer or copolymers, specialty polymers offered for (hydrophilic) surface modification (like Rewocare 755 and Polyquart Pro) and the cationic polymer (Salcare SC 60) do not result into good visual appearance of the oven.

Their results on visual appearance are comparable to the reference product without any added polymer.

Furthermore, use of product Etolit Clean in the cleaning solution showed very limited drying benefits and still left many water marks in the cooking chamber, and thus did not result in good visual appearance of the oven.

Overall, these results indicate that the positive effects of cationic polysaccharides present in the cleaning solution of an oven cleaning process are very unique.

EXAMPLE 4

In this example the effect of various cationic polysaccharides present in a cleaning solution on visual appearance of the oven is tested for manual cleaning processes.

For these trials, detergents containing cationic polysaccharides as described in example 3 were used. These detergents were sprayed manually with a trigger spray over stainless steel and glass substrates, which were placed in the oven. After 3 minutes, these substrates were rinsed with tap water. After this cleaning process, visual appearance of these substrates in the oven was evaluated by counting the number of water droplets attached to these substrates. Furthermore, after drying, these substrates were evaluated visually by giving a score from 0 (very significant level of watermarks clearly visible) to 10 (no visual watermarks).

The results for the visual evaluations of the substrates after the manual cleaning processes are given in table 6.

TABLE 6

Visual appearance; number of spots and visual scores for cationic polysaccharides present in cleaning solution

| Cationic Polysaccharide | Steel substrate | Glass substrate | Steel substrate | Glass substrate |
|---|---|---|---|---|
| | Number of droplets | | Visual score | |
| 1 none: Reference | 230 | 150 | 1 | 2 |
| 2 Hi Cat CWS42 | 15 | 5 | 8 | 7 |
| 3 SolsaCAT 16A | 31 | 2 | 6 | 8 |
| 4 Jaguar C162 | 1 | 2 | 9 | 8 |
| 5 Jaguar C1000 | 23 | 3 | 7 | 8 |
| 6 SoftCAT SX-400H | 1 | 2 | 9 | 8 |
| 7 UCARE LR 30M | 6 | 4 | 8 | 7 |

These results show that the manual cleaning process with reference detergent 1 leads to many spots on steel and glass surfaces, which results into a low score for visual appearance. The detergents containing various cationic polysaccharides lead to much less spots and so much better visual appearance of the surfaces in the oven. These examples illustrate that cationic polysaccharides have also positive effects on manual cleaning processes in ovens.

The invention claimed is:

1. A method for cleaning an oven comprising contacting at least the cooking chamber of the oven with a cleaning composition comprising a sheeting polymer that provides a layer on the surfaces of at least the cooking chamber so as to afford a sheeting action of water over the cooking chamber in an aqueous rinse step with water, the water free of a rinse aid and a descaling agent, followed by rinsing at least the cooking chamber with the water, wherein the sheeting polymer is (3-Chloro-2-Hydroxypropyl) Trimethylammonium Chloride modified starch.

2. A method for cleaning an oven comprising contacting at least the cooking chamber of the oven with a cleaning composition comprising a sheeting polymer that provides a layer on the surfaces of at least the cooking chamber so as to afford a sheeting action of water over the cooking chamber in an aqueous rinse step, wherein the sheeting polymer is a maleic acid-di-isobutylene copolymer having the formula

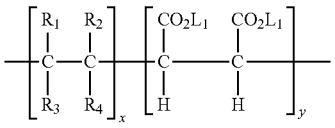

wherein $L_1$ is hydrogen or sodium, $R_1$ and $R_3$ are hydrogen, $R_2$ is methyl, $R_4$ is neopentyl, x is 1, and y is 1.

3. The method according to claim 1, wherein the step of rinsing occurs prior to drying the cooking chamber.

4. The method according to claim 1, wherein the cleaning composition is in the form of a powder, granulated powder, tablet, solid block, aqueous solution, emulsion, structured liquid or gel.

5. The method according to claim 1, wherein the cleaning composition is a powder and/or a granulate and is packed in a sachet of a water-soluble polymer.

6. The method according to claim 1, wherein the sheeting polymer constitutes 1 to 5% (w/w), based on total (wet or dry) weight of the composition.

7. The method according to claim 1, wherein the concentration of the sheeting polymer in an aqueous cleaning solution obtainable by diluting or dissolving the cleaning composition in water is from 20 to 300 ppm.

8. The method according to claim 1, wherein the contacting is done manually and/or automatically.

9. The method according to claim 8, wherein the contacting is done by spraying, fogging, wiping and/or circulating the cleaning composition or a cleaning solution obtained by diluting or dissolving the cleaning composition in water in at least the cooking chamber of the oven.

10. The method according to claim 1, wherein the number of spots on a steel surface of the cooking chamber cleaned by the cleaning composition is reduced by a factor of at least about 24 as compared to the steel surface of the cooking chamber cleaned by the cleaning composition without the sheeting polymer.

* * * * *